United States Patent [19]

Porter

[11] 4,263,099

[45] Apr. 21, 1981

[54] WET QUENCHING OF INCANDESCENT COKE

[75] Inventor: Richard W. Porter, Allentown, Pa.

[73] Assignee: Bethlehem Steel Corporation, Bethlehem, Pa.

[21] Appl. No.: 39,937

[22] Filed: May 17, 1979

[51] Int. Cl.[3] ..... C01B 39/08

[52] U.S. Cl. ..... 201/39; 55/257 PV; 202/227

[58] Field of Search ..... 201/1, 39; 202/227, 202/230, 263, 95, 269; 55/257 PV, 385 A; 34/242

[56] References Cited

U.S. PATENT DOCUMENTS

| | | | |
|---|---|---|---|
| 755,155 | 3/1904 | Moore | 201/39 |
| 774,330 | 11/1904 | Moore | 202/227 |
| 1,121,376 | 12/1914 | Koppers | 202/263 X |
| 2,975,106 | 3/1961 | Becker | 201/39 |
| 3,154,406 | 10/1964 | Allard | 75/60 |
| 3,619,985 | 11/1971 | Rohr | 55/89 |
| 3,684,664 | 8/1972 | Stratmann et al. | 202/227 |
| 3,806,032 | 4/1974 | Pries | 202/227 X |
| 3,843,460 | 10/1974 | Pries | 201/39 X |
| 3,959,084 | 5/1976 | Price | 201/39 |
| 4,066,513 | 1/1978 | Jablin | 201/39 |

*Primary Examiner*—Joseph Scovronek

*Attorney, Agent, or Firm*—Joseph J. O'Keefe; Charles A. Wilkinson; Michael Leach

[57] ABSTRACT

Method for the reduction of emissions from the wet quenching of incandescent coke in a quenching tower adapted to receive in its base a quench car containing the coke which comprises positioning the car with the coke in the quenching chamber of the tower, effecting a gas seal to substantially prevent air from infiltrating the quenching chamber and ascending the tower, quenching the coke with the resultant generation of steam and other quenching emissions, cooling and cleaning the emissions with water sprays, demisting the cooled emissions, sensing the external and internal pressures of the tower during the quenching process, maintaining a substantially zero gauge internal pressure by controlling the emissions flow exiting the tower and collecting, cooling and recycling the quenching and cooling waters. Apparatus for practicing the method is also disclosed.

7 Claims, 2 Drawing Figures

WET QUENCHING OF INCANDESCENT COKE

FIELD OF THE INVENTION

This invention relates to quenching towers for the wet quenching of incandescent coke ejected from coking ovens and more particularly relates to such quenching towers adapted to receive quench cars containing the coke.

BACKGROUND OF THE INVENTION

Typically the hot incandescent coke that has been pushed from a coking oven is collected in a quench car mounted on rails for transportation into the quenching chamber located in the base of a quenching tower. It is the general practice to shower the incandescent coke while contained in the quench car with large volumes of water in the form of a spray for about one to three minutes. After quenching, the car is withdrawn from the quenching tower to deliver and discharge the coke at a coke wharf.

The quenching tower customarily has an entranceway or opening in its base to permit passage of the quench car into and, in some cases, completely through the quenching chamber of the tower. When the incandescent coke retained in the cars is sprayed with water, emissions are generated which principally comprise steam containing entrained particulate matter and water droplets. These hot emissions, which ascend into the stack of the quenching tower to exhaust from the top opening, create a drafting effect that causes large volumes of air to flow into the base of the tower through the entranceways for the quench car. Upon entering the quenching chamber, these infiltrating volumes of air are heated by mixing with the hot emissions and flow quickly up and out the stack, thus enhancing the drafting effect. Moreover, the large volumes of infiltrating air greatly increase the quantity of gaseous emissions that need to be cleaned to meet increasingly stringent air pollution limitations. Tests have shown that quenching tower emissions are only 25 to 35% water vapor with the remaining 65 to 75% comprising air. This large percentage volume of air makes the quenching emissions more dilute and thus harder to clean. It also increases the gas velocity up the stack of the quenching tower, thus entraining more particulates and water droplets in the exhaust stream than would otherwise occur.

It is known in the art to control the discharge into the atmosphere of solid particles and droplets of water that are entrained in the rapidly flowing gaseous emissions by the use of clean water sprays and baffles, or mist eliminators, in the stack of the tower. However, these baffles are only effective in capturing the larger water droplets and particulates.

Numerous attempts have been made by workers in the art to reduce the volume or control the flow of quenching emissions. U.S. Pat. No. 2,975,106 to Becker provides a quenching tower with doors for completely closing off the passageways of the quench chamber to prevent the infiltration of air and reduce the volume of emissions that have to be cleaned by water sprays and baffles in the tower. U.S. Pat. No. 3,684,664 to Stratmann et al discloses another means for sealing a quench chamber from the outside air comprising a quench chamber having an entranceway or a complete tunnel-like passage for a quench car formed in the precise outline of the car. U.S. Pat. No. 3,806,032 to Pries shows adjustable louver-like closure means in the upper part of the tower to control the passage of the rising air currents and steam.

It is standard practice in the art to collect the water used in the quenching operation in a water sump for recycling. Fresh make-up water is added as necessary. Water from the water sump is supplied to the sprays in the quenching tower where a portion of the sprayed water vaporizes into steam and the remainder returns to the sump after having been warmed during the quenching process. Accordingly, the sensible heat content of this recirculated water quickly rises to the point where the sensible heat extracted from the incandescent coke during the quenching process is transformed into the latent heat of vaporization of the quench water. In this manner substantially all of the sensible heat lost by the hot coke results in the generation of volumes of steam rather than merely increasing the temperature of the quench water.

There is a need for a more effective control of quenching emissions by reducing the quantity of gas moving through the quenching tower.

There is also a need to reduce gas velocity through the quenching tower in order to reduce the entrainment of particulate matter and water droplets in the emissions.

Further there is a need to concentrate the quenching emissions so that clean water sprays can more effectively clean the emissions as well as cool the emissions to condense water vapor within the quenching tower.

SUMMARY OF THE INVENTION

The above problems and needs are satisfied by this invention for controlling quenching emissions by emission volume reduction. The quenching of the incandescent coke is performed in a quenching tower having a passageway in its base through which a quench car may travel into a lower portion of the tower which defines a quenching chamber. In the upper portion which defines a stack the quenching tower has a top opening for exhausting the emissions generated in the tower. The method comprises:

(a) positioning a car containing incandescent coke in the quenching chamber, (b) effecting a gas seal to substantially prevent air infiltration into and up the quenching tower, (c) quenching the coke with water which results in the generation of quenching emissions that ascend the tower, (d) cooling and cleaning the generated emissions in the tower with water sprays, (e) demisting the cooled emissions of step (d), (f) sensing the internal pressure of the quenching tower and the pressure external to the quenching tower, and (g) maintaining a substantially zero internal-external pressure differential across the effected gas seal by controlling the flow of the gaseous emissions exiting the quenching tower.

Advantageously, the water applied to the coke and sprayed into the generated emissions is collected, cooled and recycled. The combination of the above steps affords an effective method for controlling quenching emissions by substantially reducing the volume of quenching emissions which are generated and which must be treated as well as greatly reducing the quantity which is exhausted to the atmosphere.

Apparatus for practicing this method of quenching incandescent coke comprises a quenching tower whose lower portion defines a quenching chamber. The tower is adapted to internally receive a quench car loaded with incandescent coke and to exhaust quenching emissions out the top. A water applying means is positioned in the quenching chamber to apply water to the incandescent coke retained in the quench car. The stack portion of the quenching tower above the quenching chamber contains a first water spraying means to cool and clean the quenching emissions ascending the tower through the stack and out the top opening. A demisting means is situated intermediate the first water spraying means and the top of the tower. The quenching tower is provided with a flow damper in the stack and with means for effecting a gas seal to substantially reduce air infiltration into and up the tower. A means is also provided for sensing the internal and the external pressures of the quenching tower. This pressure sensing means is also adapted to activate a means for adjusting the flow damper in response to the sensed internal and external pressures so that substantially zero gauge pressure is maintained within the quenching tower by controlling with the flow damper the rate of the gaseous emissions discharging from the tower. The maintenance of a substantially zero gauge internal pressure reduces the quantity of air infiltrating across the gas seal and also prevents quenching emissions from being forced out the base of the tower due to excessive pressure buildup. Advantageously, means are provided to collect the water in the quenching tower, cool it and recycle it to the water applying means and the water spraying means. The combination of the above elements provides an apparatus that effectively controls quenching emissions by substantially reducing the volume of quenching emissions which are generated and which must be cleaned as well as greatly reducing the quantity which is exhausted to the atmosphere. Additionally, this invention is applicable to coke quenching systems which use streams of quench water and/or sprays of quench water to quench the incandescent coke.

DETAILED DESCRIPTION OF THE INVENTION

The method and apparatus of the present invention possess the capability to discharge only a small quantity of air and water vapor from the top of the quenching tower. This minimization of discharge is possible because air infiltration is reduced to a minimum by maintaining a substantially zero gauge pressure differential across the gas seal and because the temperature of the exhausted gases is lowered by the use of cooling water sprays. The effect of diminishing the temperature of discharged emissions can be seen from the fact that air at atmospheric pressure and 140° F. (60° C.), for example, is saturated at 20% absolute humidity. Thus if the quenching emissions to be exhausted are cooled to 140° F. (60° C.), there will be only one-fourth mole of water vapor leaving the quenching tower per mole of air. Additional cooling will further reduce the amount of water vapor leaving the tower.

In addition, the following benefits will be realized from a substantial reduction in the quantity of air and water vapor discharged: (1) the remaining pollutants will be so highly concentrated that the water sprays will be much more effective in reducing gaseous and particulate emissions than they would otherwise be; (2) the water spray cooling causes condensation which is conductive to particulate removal because the particulates tend to serve as condensation nuclei and then grow into water droplets which will subsequently be removed in a demister; (3) cooler temperatures will increase the solubility of gaseous pollutants in the sprayed water increasing the removal of these gaseous pollutants; and (4) a greatly reduced quantity of emissions means a greatly diminished exhaust velocity which will tend to prevent discharging of most of the water droplets in the exhaust because they will either fall to the bottom of the tower due to gravity alone or be removed more efficiently in a demister.

Figure 1:
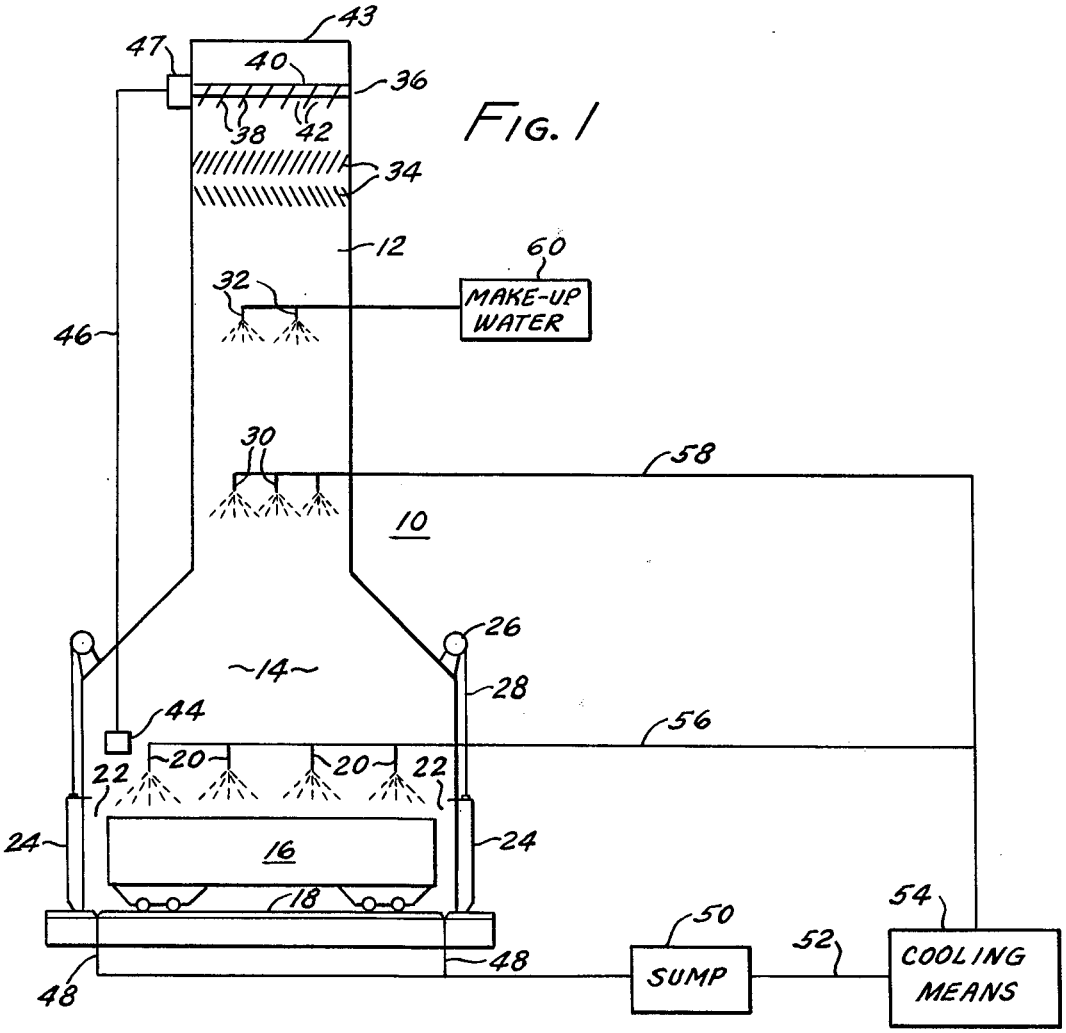
FIG. 1 is an elevational view in section of a quenching tower for practicing the invention.

Referring to FIG. 1, quenching tower 10 comprises a stack 12 and a quenching chamber 14. Quench car 16, which is propelled on tracks 18 by a locomotive, not shown, through passageways 22 in either side of the base of tower 10, is positioned within quenching chamber 14 beneath a plurality of spaced quench water sprayers 20. Doors 24 are gas sealingly positioned across the passageways 22 and can be raised and lowered by motorized pulleys 26 and cables 28.

Water sprayers 30 issue recirculated water for cooling and cleaning the quenching emissions in stack 12. Clean make-up water from sprayers 32 further cools and scrubs the emissions. Demisters 34 which can be, for example, baffles, packing, or other mist eliminating means are located above the water sprayers 30 and 32 to remove entrained particulate matter and water droplets from the emissions by impaction of the water droplets upon the large surface area of the demister apparatus as the emissions course the tortuous pathway through the demister.

Flow damper 36 has a plurality of spaced vanes or slats 38 mounted on horizontal bars 40 in a pivoting fashion such that by longitudinal movement of the bars 40 the gas flow spacing 42 between the slats 38 can be increased, or decreased to eventually result in closing of the passage through the damper by overlapping of the slats 38. For a more detailed description of such a flow damping apparatus reference may be made to U.S. Pat. No. 3,806,032 to Pries which discloses adjustable louver-like apparatus. Flow damper 36 may be any adjustable arrangement or shutter for regulating the flow of gases in a stack or flue. The flow damper 36 may be located at any level in the stack but it is preferably set near the top opening 43.

Pressure sensing means 44 within quenching chamber 14 near one of the passageways 22 and its associated gas sealing door 24 is electrically connected via line 46 to adjusting means 47 which automatically regulates flow damper 36. Adjusting means 47 may be fluid activated cylinders such as hydraulic or pneumatic cylinders. Pressure sensing means 44 which measures the internal pressure of quenching chamber 14 relative to the external pressure is adapted to electrically activate adjusting means 47 which causes flow damper 36 to open or close, i.e. increase or decrease the gas flow spacings 42.

Pressure sensing means 44 may be, for example, a differential pressure transmitter comprising a diaphragm or bellows sensing element and a motion to current transducer which converts the mechanical movement of the sensing element to a current output. The opposite sides of the diaphragm or bellows sensing element are separately exposed to the external and the internal pressures via pressure impulse inlets. A differential pressure across the sensing element moves an attached core within a coil. The relative position of the core within the coil produces an A-C signal which is proportional to the applied differential pressure and is connected to a DC current output. The current regulated output can be fed into a variety of instruments. Such differential pressure transmitters are manufactured by The Hays Corporation, Michigan City, Ind.

The nonvaporized water, which had been sprayed into quenching tower 10, is collected in drainage lines 48 and is conducted to a sump 50. From sump 50 the water is sent by line 52 to a cooling means 54 which may be a cooling tower or cooling pond, for example, to lower the temperature of the water. Advantageously, means may be provided for separating suspended solids from the water. After the sensible heat content of the water has been sufficiently reduced and suspended solids removed, the water is recycled to water sprayers 20 and 30 via lines 56 and 58, respectively. To replace the quantity of water that does leave the quenching tower as water vapor, or as moisture in the quenched coke, fresh make-up water 60 is added through water sprayers 32.

In operation quench car 16 containing incandescent coke pushed from a coking oven is propelled along rails 18 from a coke oven battery to quenching tower 10. One of the doors 24 is brought to its raised position by motorized pulley 26 and the coke laden quench car 16 is pushed through open passageway 22 and positoned within quenching chamber 14. Pulley 26 then releases additional lengths of cable 28. to lower door 24 into a gas sealing engagement across the passageway 22 in the base of the tower. If the tower is provided with an additional passageway 22 and a second door 24 so that the quench car can be propelled completely through the base of the tower, as shown in FIG. 1, the second door 24 is maintained also in a closed gas sealing engagement across the second passageway. Air infiltration into the tower is thus substantially reduced. It must be recognized, however, that it is impossible in practical terms to effect an absolute gas seal that permits no gas flow across the seal because of the thermal stress and corrosion due to the hostile environment. Small cracks and gaps are realistically to be expected. Nevertheless, the vast bulk of the open passageway area can be effectively sealed.

Water is sprayed from water sprayers 20 onto the incandescent coke in the quench car 16 generating large volumes of steam containing entrained particulates and water droplets. During quenching the emissions proceed to expand and ascend stack 12. The increased internal pressure in quenching chamber 14 due to the production of gases is immediately sensed by pressure sensing means 44 which electrically activates adjusting means 47 to adjust the positioning of the vanes 38 of flow damper 36 to permit the gases to readily exhaust from the tower. The flow damper 36 is adjusted in a manner that allows emissions to exit opening 43 in the stack 12 at a rate such that a substantially zero pressure differential is maintained across the gas seal. By maintaining the internal pressure at substantially zero gauge pressure relative to the external pressure, there will be essentially no infiltration of air via any cracks or gaps in the effected gas seal which would create a drafting effect. Accordingly, the volume of gaseous emissions that must be cleaned is greatly decreased. Furthermore, virtually no generated emissions will be forced out the base of the tower through these cracks and gaps since an excessive internal pressure is not attained.

Thus, the generated emissions of steam, water droplets and particulate matter, unaugmented by large quantities of drafted ambient air, ascend stack 12 where they are cooled and scrubbed first by recooled, recirculated water from water sprayers 30 and then by fresh make-up water from water sprayers 32 to clean and further reduce their volume. As the water-treated emissions continue to ascend the stack, water droplets and particulates are removed as they impact the surfaces of the mist eliminating means 34. The cleaned, reduced volumes of emissions flow through damper apparatus 36 to exhaust to the atmosphere.

Water from sprayers 20, 30 and 32, water draining from the bottom of quench car 16 and water droplets removed from the emissions collect in the bottom of the quenching tower and are temporarily stored in sump 50. The temperature of this water has increased because the water has gained sensible heat from its contact cooling of the coke and from cooling the generated steam with the concomitant condensation of a substantial portion of the steam to water droplets. In other words, the sensible heat lost by the cooled coke and the cooled steam and the latent heat from the condensation of the steam to water droplets have been captured as the increased sensible heat content of the used water. In cooling means 54 the temperature of this water is lowered, that is to say its sensible heat content is decreased, prior to recirculating to the quenching sprayers in the quenching chamber. Thus, the cooled water can absorb more sensible heat from the hot coke before it is raised to the temperature at which it will be vaporized to steam than uncooled, recirculated water can absorb before vaporizing. This results in significantly less steam being generated by the sensible heat extracted from the coke being quenched.

With a reduced quantity of steam and emissions entering the stack, the cooled, recirculated water from water sprayers 30 and the cold, clean make-up water from sprayers 32 can more effectively cool and scrub these gases. This technique cools these emissions to the point where most of the steam that is generated is condensed to water. The almost complete condensation further reduces the quantity of emissions. Furthermore, the condensation is conducive to particulate removal because the particulates serve as condensation nuclei which grow into water droplets. In addition, cooler temperatures increase the solubility of gaseous pollutants in the water from the sprayers. Further, a greatly reduced quantity of steam and other emissions means a greatly reduced exhaust velocity which allows most of the water droplets in the exhaust to fall by themselves back into the system or to be more effectively removed in a mist eliminator.

Figure 2:
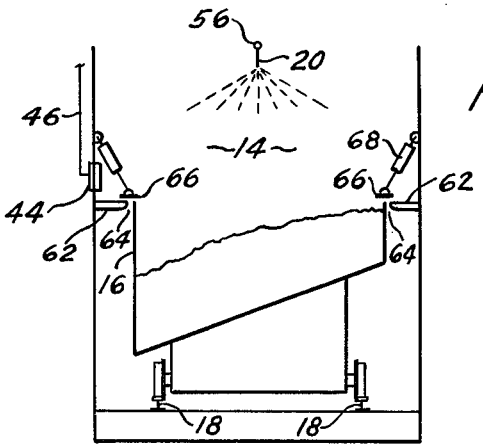
FIG. 2 is a side elevational view of the lower portion of a quenching tower showing an alternate means for effecting a gas seal.

FIG. 2 shows another means for effecting a gas sealing arrangement. Quenching chamber 14 is provided with sealing ledges 62 projecting from the insides of the chamber at a height corresponding to that of the top edges of the sidewalls of quench car 16. Ledges 62 terminate in close proximity to the quench car leaving only a slight gap 64 which is sealed by a sealing plate 66 lowered into position by raising and lowering means 68 which may be hydraulic or pneumatic cylinders. Similar sealing arrangements, not shown, are used to seal the end walls of the quench car. Other means known in the art for effecting a gas seal to prevent air infiltration into the quenching chamber and/or up the stack may also be used. The important factor is that a sufficient seal be effected in a position which prevents external air from being drawn or drafted into the quenching area and then up the stack during the quenching operation.

While particular embodiments of the present invention have been shown and described, it is apparent that various changes and modifications may be made, and it is therefore intended in the following claims to cover all such modifications and changes as may fall within the true spirit and scope of this invention.

I claim:

1. A method for quenching incandescent coke in a quenching tower, a lower portion of which tower defines a quenching chamber, an upper portion which defines a stack and a top opening to exhaust emissions generated in the quenching tower, comprising:

(a) positioning a car containing incandescent coke in the quenching chamber of the quenching tower, (b) effecting a gas seal to substantially prevent air infiltration into the quenching chamber and up the quenching tower during quenching of the coke, (c) quenching the coke with water resulting in the generation of quenching emissions which ascend through the tower, (d) cooling and cleaning the generated emissions in the tower with water sprays, (e) demisting the cooled emissions of step (d), (f) sensing the internal pressure of the quenching tower and the pressure external to the quenching tower, and (g) maintaining a substantially zero internal-external pressure differential across the gas seal in response to the sensed internal and external pressures by controlling the flow of the gaseous emissions exiting the tower.

2. The method of claim 1 including the collecting, cooling and recycling of the water from steps (c) and (d).

3. The method of claims 1 or 2 in which the flow of emissions exiting the tower is controlled by adjusting a flow damper located in the quenching tower.

4. The method of claim 3 in which the internal pressure is sensed near the gas seal.

5. Apparatus for quenching incandescent coke, comprising:

(a) a coke quenching tower which defines a quenching chamber in its lower portion and a stack in its upper portion to exhaust quenching emissions out a top opening and which is adapted to internally receive a quench car loaded with coke, the tower having a water applying means in the quenching chamber to apply water to the incandescent coke in the quench car, a water spraying means to cool and clean the quenching emissions ascending through the stack, and demisting means intermediate the spraying means and the top of the tower, (b) means for effecting a gas seal to substantially reduce air infiltration into the quenching chamber and up the quenching tower, (c) a flow damper located in the stack to control the flow of gaseous emissions exiting the tower, (d) means for adjusting the flow damper, (e) means for sensing the internal and the external pressures of the quenching tower, the sensing means being adapted to activate the flow damper adjusting means in response to the sensed internal and external pressures so that substantially zero gauge pressure is maintained within the quenching tower.

6. The apparatus of claim 5 including (f) means to collect, cool and recycle the water to the water applying means and the water spraying means.

7. The apparatus of claim 6 including (g) a second water spraying means in the stack above the first water spraying means to supply make-up water.

* * * * *